US006080274A

United States Patent [19]

Hautala et al.

[11] Patent Number: 6,080,274

[45] Date of Patent: Jun. 27, 2000

[54] METHOD FOR CONTROLLING A MULTI-PHASE SCREENING APPARATUS

[75] Inventors: Jouko Hautala; Juhani Valli; Timo Vuorinen; Jorma Petäjistö, all of Tampere, Finland

[73] Assignee: Valmet Corporation, Helsinki, Finland

[21] Appl. No.: 09/053,280

[22] Filed: Apr. 1, 1998

Related U.S. Application Data

[60] Provisional application No. 60/051,708, Jul. 3, 1997.

[30] Foreign Application Priority Data

May 6, 1997 [FI] Finland ..... 971938

[51] Int. Cl.[7] ..... D21C 9/08

[52] U.S. Cl. ..... 162/55; 162/61

[58] Field of Search ..... 162/61, 55

[56] References Cited

U.S. PATENT DOCUMENTS

| | | | |
|---|---|---|---|
| 4,207,141 | 6/1980 | Seymour | 162/49 |
| 4,504,016 | 3/1985 | Wikdahl | 421/24 |
| 4,994,145 | 2/1991 | Seymour | 162/49 |
| 5,534,139 | 7/1996 | Cadek et al. | 210/96.1 |

*Primary Examiner*—Christopher A. Fiorilla
*Attorney, Agent, or Firm*—Ladas & Parry

[57] ABSTRACT

A method and apparatus for controlling a multi-step screening apparatus (1) controls other accept, reject and dilution flows in relation to the flow measured in the accept channel (7*a*) of the first screening step (3*a*). Thus a simpler control unit (9) can be used and accept of higher quality can be obtained than before. The apparatus has a control unit (9) aranged to measure the flows of all accept, reject and dilution water channels (7*a*–7*c*, 5*a*, 5*b*, 11*a*, 11*b*) and to adjust the flow of the other channels on the basis of the flow of the accept channel of the first step.

6 Claims, 1 Drawing Sheet

METHOD FOR CONTROLLING A MULTI-PHASE SCREENING APPARATUS

Figure 1:
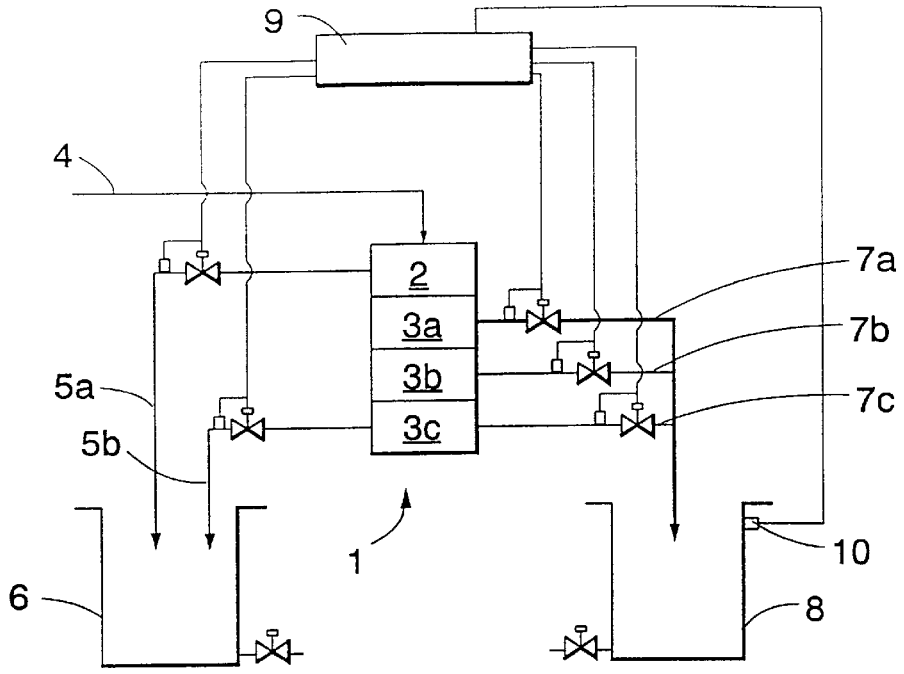

This application is based an U.S. provisional application No. 60/051,708 filed Jul. 3, 1997.

The invention relates to a method for controlling a multi-step screening apparatus, said method comprising measuring flows of accept and reject channels of the screening apparatus comprising at least two steps, and adjusting their flow by means of regulating valves mounted in the channels.

The invention further relates to an apparatus for controlling a multi-step screening apparatus, said apparatus comprising a control unit arranged to measure flows of accept and reject channels of the screening apparatus by means of measuring devices provided in the channels, and to regulate accept and reject flows of the screening apparatus by means of regulating valves mounted in the channels.

Screening apparatuses are used for screening pulp in order to obtain the most suitable pulp for the manufacture of paper or board. The screening removes various impurities, such as splinters, any fibre bundles, and other impurities disadvantageous in view of the manufacture and quality of the finished web. The screening is performed by screening apparatuses comprising one or more screen cylinders or corresponding members provided with apertures. The area and apertures or slots of these cylinders or corresponding members are dimensioned such that the accepted pulp fraction, i.e. accept, is allowed to pass through the apertures of the screen as easily as possible, whereas impurities and fibres that are too big are not allowed to pass therethrough. In modern papermaking, it is very important to achieve as pure accept and as high screening capacity as possible. As a result of this, part of the acceptable material ends up in the rejected pulp fraction, i.e. reject, wherefore it is economical to screen the reject again for recovering such fibre material. Multi-step screening is thus used to ensure that the desired quality is obtained.

There are various prior art multi-step screens, so-called combined screens, in which the screening of pulp and of reject is effected in two or three successive steps. The apparatuses thus comprise a plurality of operationally successive screening steps. The pulp to be screened is usually supplied to the first step of the screening apparatus, i.e. to the coarse screen. The coarse screen separates the coarsest material, such as splinters and fibre bundles, from the pulp. This material is removed from the screening apparatus and supplied through channels to a reject container. The pulp that has passed through the coarse screening flows to the actual screening steps, in which the pulp that has passed through the screen is supplied through channels to an accept container or the like. The reject is diluted with water, if necessary, and supplied to the following screening step, in which the pulp fraction that has passed through the screen drum is recirculated to the accept channel. Usually a screening apparatus thus comprises a plurality of successive screens which screen the pulp such that the last reject is finally discharged from the screening apparatus through a channel to the reject container.

In prior art solutions, the screening apparatus is controlled by a complicated automation system with a high calculation capacity. The aim of the control system is to estimate the internal flows of the screening apparatus by calculating. However, such a control system has proved to be rather complicated and to set high requirements for the capacity of the automation system.

The object of the present invention is to provide a simpler solution for controlling a multi-step screening apparatus.

The method of the invention is characterized in that the flows of the reject channels and the other accept channels of the screening apparatus are controlled in relation to the flow of the accept channel of the first step of the screening apparatus.

The apparatus of the invention is characterized in that the control unit is arranged to control the flows of other accept and reject channels in relation to the flow of the accept channel of the first step of the screening apparatus.

A basic idea of the invention is that a multi-step screening apparatus is controlled by controlling other accept and reject flows of the screening apparatus in relation to the accept flow of the first screening step, which renders the complicated estimation of internal flows by calculating unnecessary. The idea of another embodiment of the invention is that in the steps following the first screening step, dilution water is supplied to the pulp in relation to the accept flow of the first step. The idea of yet another embodiment of the invention is that the accept flow of the first step of the screening apparatus is adjusted according to the need of either the feeding or the receiving accept container.

An advantage of the invention is that the control system can be simplified to a great extent, and that the solution can be successfully applied to even simple existing automation systems. The solution of the invention does not set as high requirements for the calculation capacity of the automation system as the known solutions. A simpler control system is naturally also less expensive. A further advantage is that a system in which the invention is applied rapidly adapts to variations in production, is easily controllable and stable, and allows an accept of equal quality to be produced.

Figure 2:
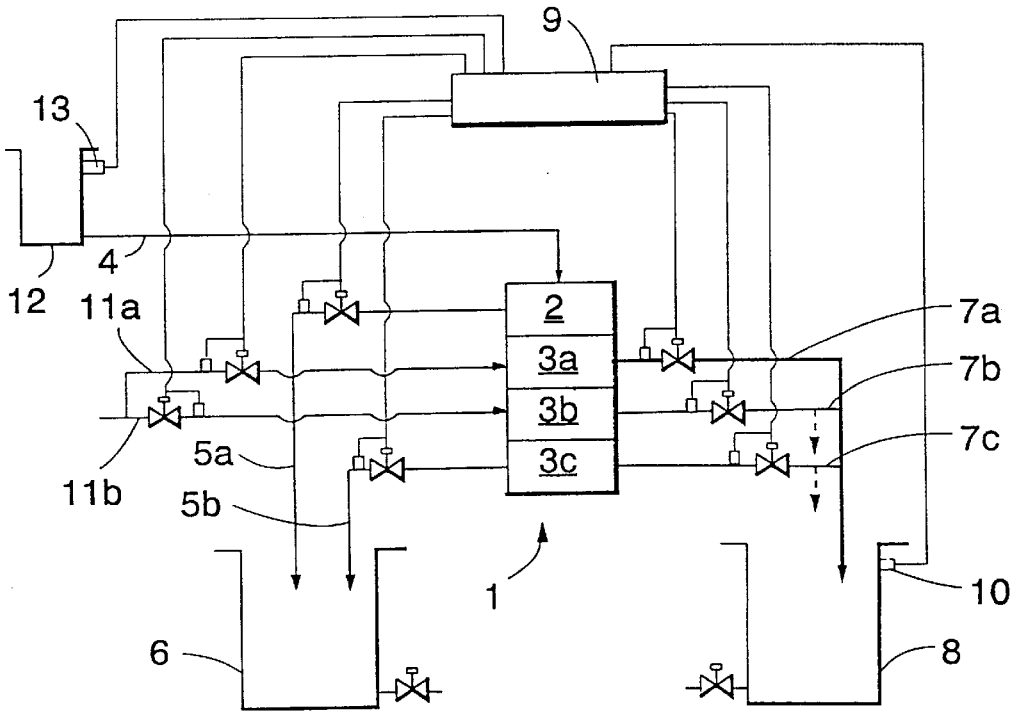

In the following, the invention will be described in greater detail with reference to the accompanying drawings, in which FIG. 1 is a schematic view of a solution of the invention for controlling a multi-step screening apparatus, and FIG. 2 is a schematic view of another solution of the invention for controlling a multi-step screening apparatus.

FIG. 1 is a schematic view of a solution of the invention for controlling a multi-step screening apparatus. The four-step screening apparatus 1 shown in the figure comprises coarse screening 2 and subsequent primary screening compartments 3*a* to 3*c*, which perform the actual screening. Screening apparatuses may also comprise only two or three steps, or they may comprise more than four steps. The number of screening steps required depends on the screening capacity, quality and minimum amount of reject required. The pulp to be treated is supplied to the coarse screen 2 of the screening apparatus 1 through a supply channel 4. The pulp that has passed through the coarse screen 2 flows to the following screening steps 3*a* to 3*c*. The material that has not passed through the coarse screen 2, such as splinters and fibre bundles, is removed from the screening apparatus 1 and supplied through a first reject channel 5*a* to a reject container 6. After each screening step 3*a* to 3*c*, the accept that has passed through is supplied through accept channels 7*a* to 7*c* to an accept container 8. The pulp that remains after the last screening step 3*c* is supplied through a second reject channel 5*b* to a reject container 6. The reject obtained after the coarse screening 2 and the reject obtained after screen 3*c* can be supplied either to the same reject container or separately to different further treatment processes.

The screening apparatus 1 described above is controlled by a control unit 9, e.g. a computer or a programmable logic controller, which measures the flow rate and, if necessary, the pressure of all channels 5*a* to 5*b* and 7*a* to 7*c*, except for the supply channel 4; it also controls the valves mounted in the channels. For reasons of clarity, the measuring devices and the valves to be controlled are connected in the figure to the control unit 9 by the same line. The control is based on data obtained by measuring the accept channel 7*a* of the first step 3*a*. On the basis of these data, the flows of the other channels 5*a*, 5*b* and 7*b*, 7*c* are regulated to make the screening apparatus operate efficiently and to produce high-quality accept. It is quite possible that the ratio between the flow of each of the other accept and reject channels 7*b*, 7*c* and 5*a*, 5*b* and the accept channel 7*a* of the first step is kept constant. For reasons of clarity, the accept channel 7*a* of the first step is indicated in the figure by a thicker line. If necessary, the flow of the other accept channels 7*b*, 7*c* can also be either completely or partly supplied to a container different from the accept container 8 to which the accept flow 7*a* of the first step is supplied. This is indicated in FIG. 2 by broken lines. The figure also shows a pulp level measuring means 10, by means of which the amount of accept in the accept container 8 can be monitored. The data obtained by the measuring means 10 is transmitted to the control unit 9, which, if necessary, regulates the accept flow 7*a* of the first screening step on the basis of the measurement data obtained, and the flow of the other accept channels 7*b*, 7*c* in relation to the flow of the accept channel 7*a* of the first step. Thus the desired amount of flow is made to pass through the screening apparatus 1, and the pulp level in the accept container 8 is kept within predetermined limits.

FIG. 2 is a schematic view of another solution of the invention for controlling a multi-step screening apparatus. The apparatus shown in FIG. 2 corresponds to the apparatus illustrated in FIG. 1 except that, after the first screening step 3*a* and the second screening step 3*b*, dilution water is supplied to the pulp that has not passed through the screen to dilute the mixture and to help the pulp fibres pass through the screen of the following screening step. It is not always necessary to supply dilution water, but in view of the screening it is advantageous in many cases, since more water in relation to fibres usually flows through the screen apertures in the preceding screening steps. Thus the supply of dilution water allows the fibre-water ratio of the pulp that is being screened to be equalized. The flows, and if necessary the pressures, of the dilution water channels 11*a* and 11*b* are also measured. The control unit 9 controls the supply of dilution water in relation to the accept flow of the first screening step 3*a*. FIG. 2 also shows a supply container 12, the pulp level of which is measured by another measuring device 13. Thus the accept flow 7*a* of the first screening step can be regulated on the basis of the pulp level data of either the supply container 12 or the accept container 8. The flow and pressure of the supply channel 4 do not necessarily have to be measured, and the flow in the channel is not regulated separately at all.

The drawings and the description relating thereto are intended merely to illustrate the inventive concept. In its details, the invention may be modified within the scope of the appended claims. The screening apparatus may thus vary in its structural details: it may, for example, comprise successive screens that are either plate-like or cylindrical.

What is claimed is:

1. A method for controlling a multi-step screening apparatus, said method comprising:

measuring flows of accept and reject channels of the screening apparatus comprising at least first and second steps and adjusting their flow by means of regulating valves mounted in the channels wherein the flows of the reject channels and the other accept channels of the screening apparatus are controlled in relation to the flow of the accept channel of the first step of the screening apparatus.

2. A method according to claim 1, wherein dilution water is supplied to at least one pulp fraction remaining after a screening step following the first step through dilution water channels controlled in relation to the flow of the accept channel of the first step.

3. A method according to claim 2, wherein the ratio of the reject channels, dilution water channels and the other accept channels to the flow of the accept channel of the first step is constant.

4. A method according to claim 1, wherein the flow of the accept channel of the first step of the screening apparatus is controlled according to the need of the supplying or receiving container.

5. A method according to claim 4, wherein the flow of the accept channel of the first step of the screening apparatus is controlled according to a pulp level of a accept container following the screening apparatus.

6. A method according to claim 4, wherein the flow of the accept channel of the first step of the screening apparatus is controlled according to a pulp level of a supply container preceding the screening apparatus.

* * * * *